US005551610A

United States Patent [19]

Clifton, Jr.

[11] Patent Number: 5,551,610

[45] Date of Patent: Sep. 3, 1996

[54] TRUNCHEON HOLSTER

[76] Inventor: Norman E. Clifton, Jr., 607 Trumpetvine Ct., Jacksonville, Fla. 32225

[21] Appl. No.: 275,582

[22] Filed: Jul. 15, 1994

[51] Int. Cl.[6] ..... F41C 33/00

[52] U.S. Cl. ..... 224/197; 224/193; 224/247; 224/914; 224/675; 224/677

[58] Field of Search ..... 224/191, 194, 224/195, 197, 200, 247, 253, 914, 242, 243, 234, 193, 196, 198, 244, 911, 912, 232, 226, 192, 904; D3/229

[56] References Cited

U.S. PATENT DOCUMENTS

| | | | |
|---|---|---|---|
| 2,443,397 | 6/1948 | Myres | 224/243 |
| 4,084,734 | 4/1978 | Bianchi et al. | 224/911 |
| 4,286,741 | 9/1981 | Rogers | 224/243 |
| 4,662,552 | 5/1987 | Uyehara | 224/914 |
| 4,886,197 | 12/1989 | Bowles et al. | 224/243 |
| 4,953,769 | 9/1990 | Parsons et al. | 224/914 |
| 5,018,653 | 5/1991 | Shoemaker | 224/198 |
| 5,209,383 | 5/1993 | Theodore | 224/911 |
| 5,251,798 | 10/1993 | Theodore | 224/912 |
| 5,251,799 | 10/1993 | Theodore | 224/912 |
| 5,265,781 | 11/1993 | Nichols | 224/198 |
| 5,282,559 | 2/1994 | Wisser et al. | 224/243 |
| 5,419,472 | 5/1995 | Hellweg et al. | 224/193 |

FOREIGN PATENT DOCUMENTS

| | | | |
|---|---|---|---|
| 2256700 | 12/1992 | United Kingdom | 224/198 |

*Primary Examiner*—Henry J. Recla
*Assistant Examiner*—Gregory M. Vidovich
*Attorney, Agent, or Firm*—Arthur G. Yeager

[57] ABSTRACT

Holster for a truncheon, the holster being a unitary folded substantially sheet which is folded along a front portion and having meeting edges along a rear portion, and a transverse screw-and-nut combination connecting the two folded portions of the sheet to provide an adjustment to the clamping action of the holster to the truncheon. An optional keeper strap with a quick-opening fastener, and a thumb-engageable tab may be included to maintain the truncheon securely in the holster until the tab is pushed to open the holster. A pivotable belt loop member is attached to the holster and is adjustable to provide convenient positions for supporting the holster and truncheon in any position.

19 Claims, 6 Drawing Sheets

TRUNCHEON HOLSTER

BACKGROUND OF THE INVENTION

Police officers are frequently called upon to maintain order when civil disturbances occur, such as strikes, riots, protests, etc. The normal weapon employed is a truncheon or cudgel or "night stick". In the past, these weapons have, for the most part, merely been a cylindrical wooden rod or club 12–24 inches long with or without a thong loop attached to the handle and available to wrap around the hand or wrist of the officer. These weapons are bulky, not easily carried when not in use, and do not adapt well to defensive use. There has been developed a modern truncheon useful both offensively and defensively, which is described and claimed in U.S. Pat. No. 5,295,687 to Bedard. This weapon has an elongated shaft and a hilt having general shape of a sword, i.e., a handle grip and a cross guard of two short laterally extending arms. The present invention is a holster for suspending this truncheon from the wearer's belt. It is important in today's use of automobiles that a truncheon holster be capable of carrying the truncheon on a weaver's belt while the wearer is seated in the automobile or walking, and this flexibility has been incorporated in the present invention.

It is an object of the present invention to provide a novel adjustable holster for a truncheon. It is another object of this invention to provide a holster for the truncheon described in U.S. Pat. No. 5,295,687. Still other objects will become apparent from the more detailed description which follows.

BRIEF SUMMARY OF THE INVENTION

This invention relates to an adjustable holster for a truncheon, which may or may not have a cross guard. The holster includes an outside wall, an inside wall, an open top and an open bottom, an open front, an open rear port, a belt loop, and adjustment means to apply more or less force to the walls clamping around the truncheon. A keeper strap pivotally attached to the outside wall and extending transversely across the open front to a quick opening snap fastener on the inside wall is an optional feature. The keeper strap includes a thumb-engageable tab extending outwardly from the snap fastener, and the belt loop is pivotally attached to, and adjustable with respect to, the inside wall.

In specific and preferred embodiments of the invention, the holster is made of a single sheet of molded plastic material folded along a rear vertical line to produce a clam-shell design. The keeper strap is a flexible leather; and the thumb tab is reinforced with a strip of spring steel attached to the snap fastener and extending outwardly along the tab.

BRIEF DESCRIPTION OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The structural features and operational advantages of this invention are best understood in the following description which refers to the attached drawings.

Figure 1:
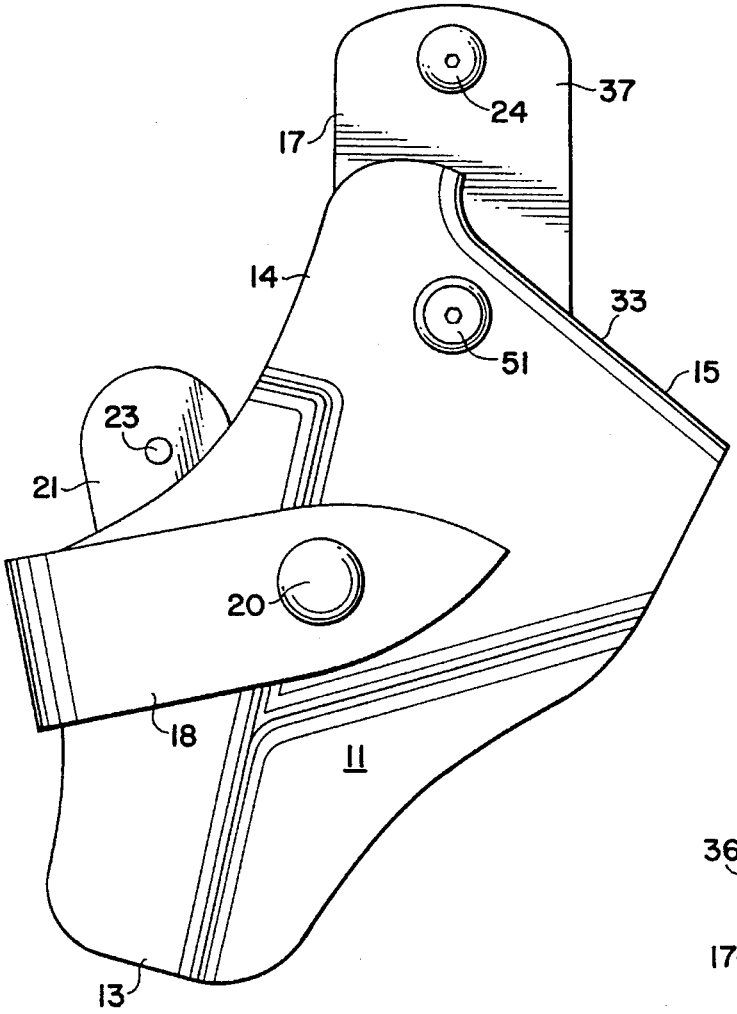
FIG. 1 is an outside elevational view of the holster of this invention.
Figure 2:
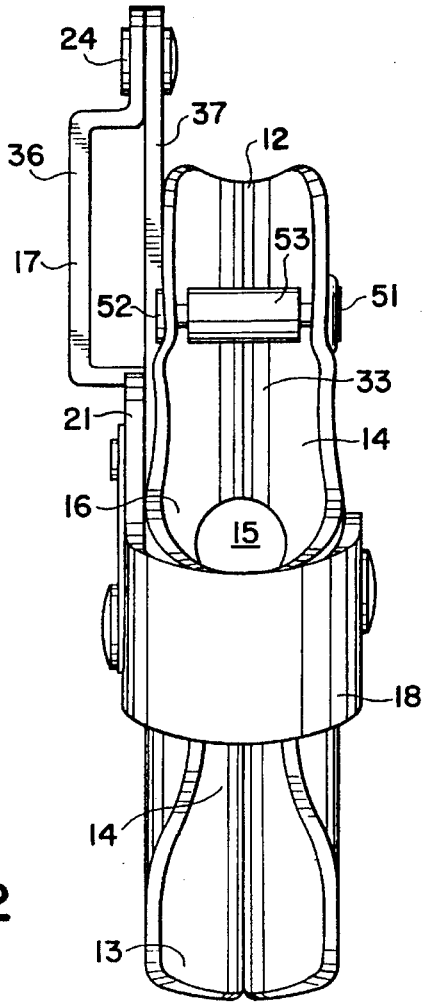
FIG. 2 is a front elevational view of the holster of this invention.
Figure 4:
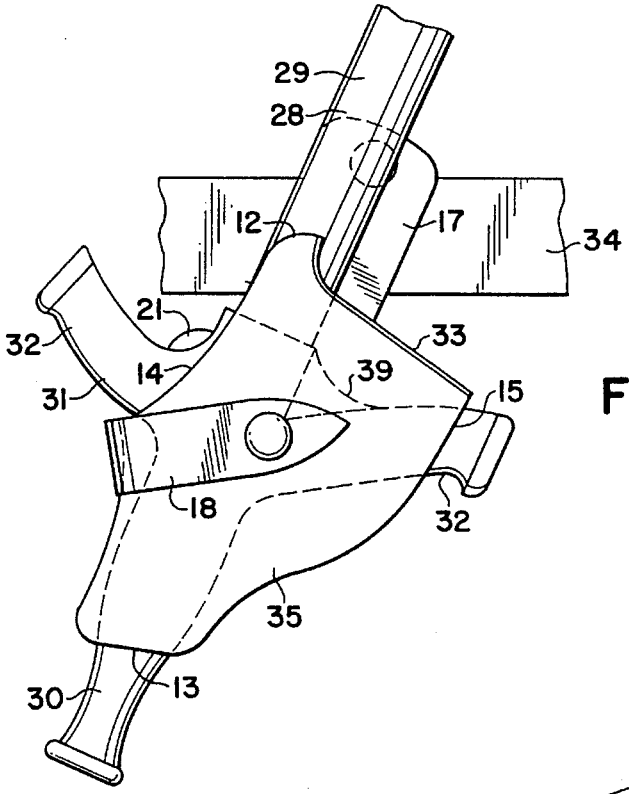
FIG. 4 is the same view as FIG. 1, but with the truncheon enclosed therein.
Figure 3:
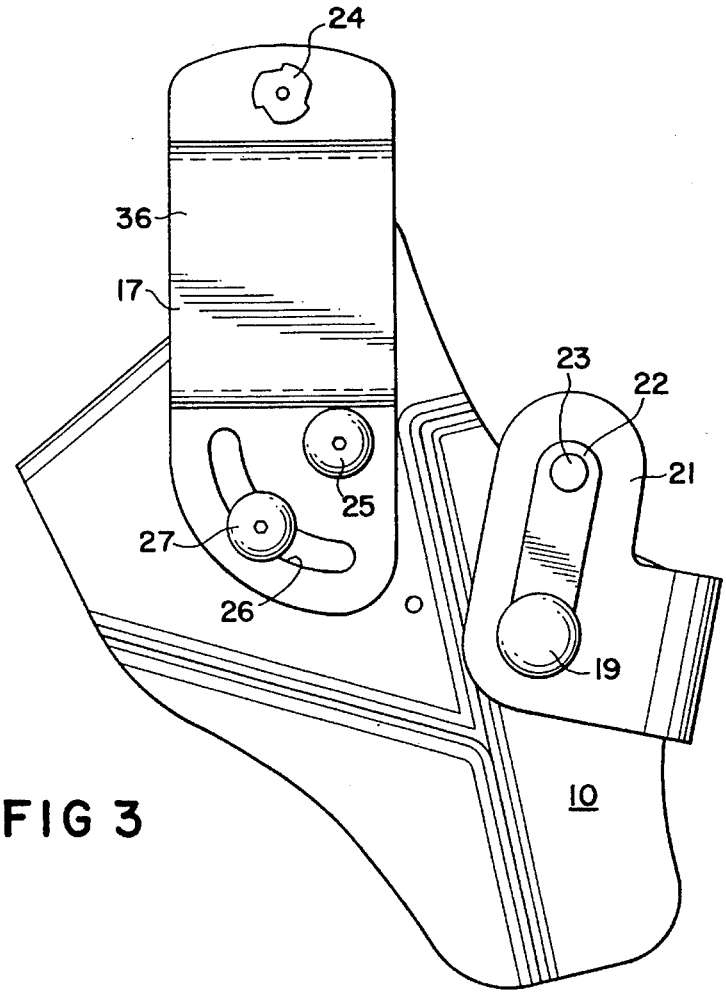
FIG. 3 is an inside elevational view of the holster of this invention.

FIGS. 1–3 show the structure and shape of the holster, and FIG. 4 shows how the holster carries the truncheon described in U.S. Pat. No. 5,295,687. As shown in FIGS. 1–3 the holster is a single sheet of molded plastic material folded along line 33 to produce an inside wall 10 and an outside wall 11 enclosing an interior cavity 16 and having an open top 12, an open bottom 13, an open front 14, and a rear port 15. When the holster is molded and the two walls 10 and 11 are folded, the two walls 10 and 11 are made to clamp slightly around the adjacent portions of the truncheon (i.e., those portions around the hilt of the truncheon) so as to apply some frictional force to prevent the truncheon from falling out of the holster by gravity. The finished holster is somewhat like a pair of clam shells spring biased toward each other by reason of the stresses around fold 33.

Across open front as an optional feature there is fastened a keeper strap 18 of leather or a flexible leather substitute. Strap 18 is permanently fastened to outside wall 11 by a pivotable screw or rivet 20. The other end of strap 18 is releasably fastened to inside wall 10 by a snap fastener 19. Thumb tab 21 extends upwardly from fastener 19 and includes a thin spring steel strip 22 fastened to tab 21 at its upper end by rivet 23. The purpose of tab 21 and stiffener 22 is to make tab 21 sufficiently stiff that the wearer's thumb can slip between inside wall 10 and tab 21 and press outwardly to release snap fastener 19 and thereby release the holstered truncheon for withdrawal from the holster. The keeper strap 18 and tab 21 are not critical to this invention.

Attached to inside wall 10 also is the belt loop, which preferably is a rigid plastic molding. The structure shown in the drawings involves two mating pieces, inside wall 36 and outside wall 37 held together by tightening screw 24, pivot screw 25, and clamping screw 27. A belt loop tunnel is formed in inside wall 36. Outside wall 37 is essentially a flat plate. For purposes of adjustment of the holster an arcuate slot 26 is cut through both walls 36 and 37 of belt loop member 17. After loosening clamping screw 27, the angle of the truncheon with respect to the waist belt of the wearer may be selected and upon tightening clamping screw 27 that angle may be fixed. This adjustment may be needed to find an angle that is comfortable for the wearer in both sitting and standing positions. It is to be understood that belt loop member 17 may be in one piece rather than two, and may be made of other materials than rigid molded plastic.

FIG. 4 shows how the truncheon is held in the holster of this invention. The handle is positioned downwardly and the staff is positioned upwardly and at an angle so as to rest against the shoulder and back of the wearer and to provide comfort when the wearer is seated, e.g., in an automobile. The truncheon 28 includes an elongated staff 29 with a sword-like hilt at one end (in this case the lower end) thereof. The hilt includes a hand grip 30 and a cross guard 31 of two oppositely directed short arms 32. Hand grip 30 projects downwardly through open bottom 13 of holster 35. One short arm 32 projects outwardly through open front 14 and the other short arm 32 projects outwardly through rear port 15. The staff 29 projects outwardly (upwardly, in this case) through open top 12. Fold 33 extends between open top 12 and rear port 15, providing positive support for the hilt, especially a web connecting spine 39. Waist belt 34 of the wearer passes through belt loop 17 of the holster 35. Holster 35 also includes a means to adjust the clamping force holding the truncheon. Screw 51 passes through outside wall 11 to nut 52 attached to inside wall 10 and can be tightened or loosened to increase or decrease, respectively, the force necessary to remove the truncheon from the holster. A roller 53 may cover the threads of screw 52 to facilitate the insertion or removal of the truncheon from the holster. It is, of course, entirely possible to adjust the holster to the opposite direction so as to allow the staff 29 to hang downwardly, e.g., when the wearer wishes to walk with the truncheon hanging from his belt.

Figure 5:
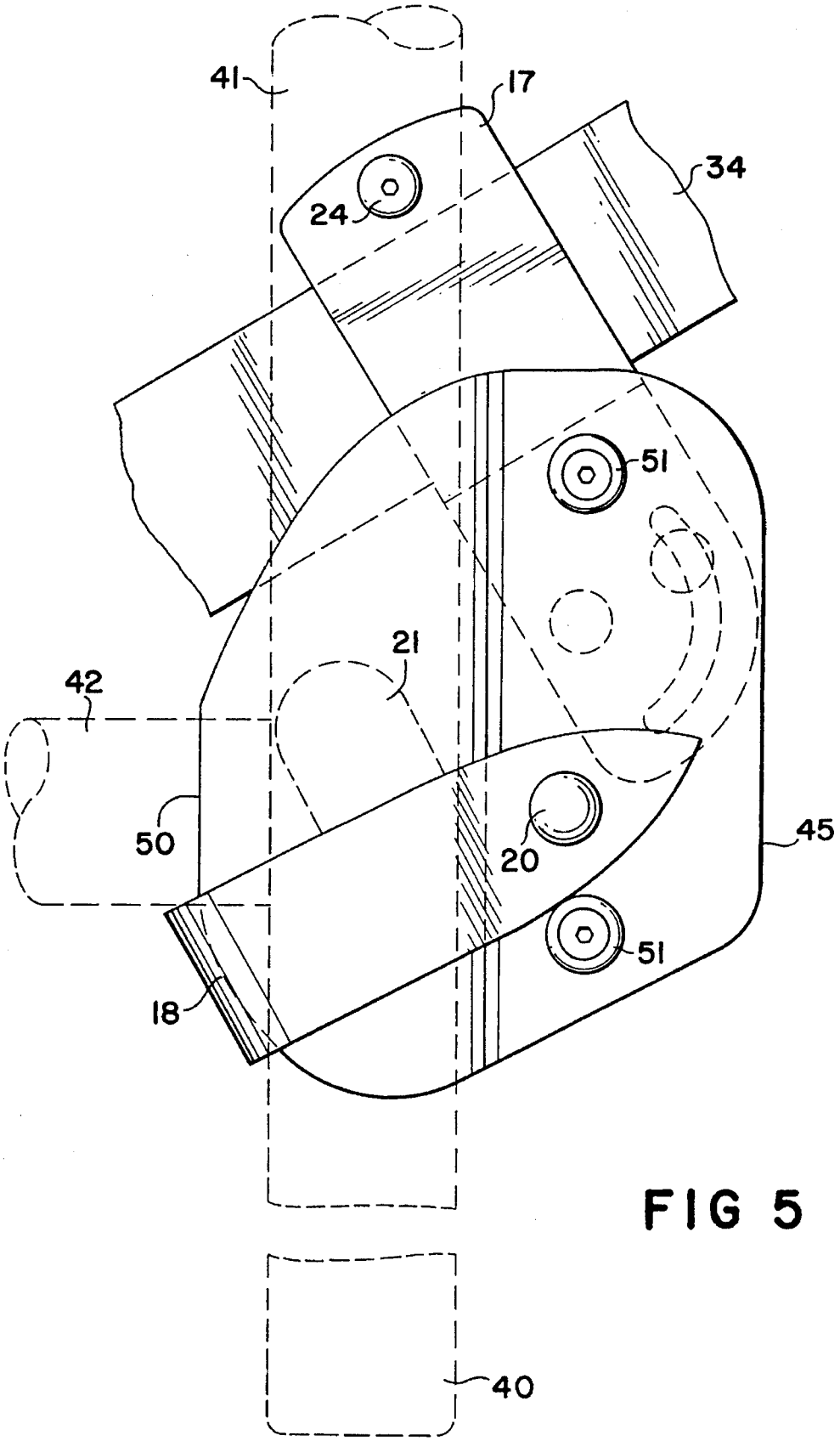
FIG. 5 is an outside elevational view of a second embodiment of the invention wherein the truncheon has a single cross arm extension.
Figure 7:
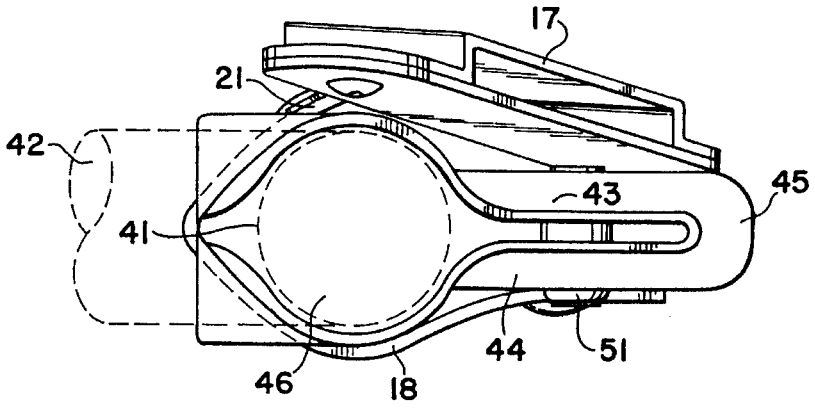
FIG. 7 is a top plan view of the embodiment of FIG. 5.
Figure 6:
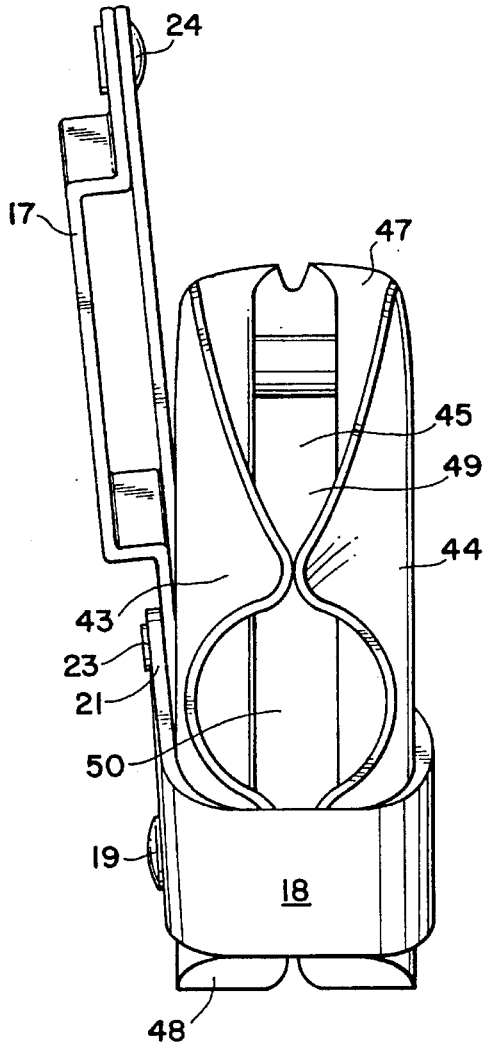
FIG. 6 is a front elevation of the embodiment of FIG. 5.

FIGS. 5–7 show a second embodiment of the holster of this invention, when used for a second design of truncheon, i.e., one having a handle 40, a staff 41, and one side arm cross guard 42 (shown in dashed lines). The holster has identical features to those of FIGS. 1–4, although shaped differently so as to fit the truncheon. Inside wall 43 and outside wall 44 are folded along the rear 45 to form an interior void 46 with an open top 47, an open bottom 48, an open front 49, and a handle port 50 to encircle handle 42. Belt loop 17, keeper strap 18, thumb tab 21, wearer's belt 34 and adjustment screws 51 are all identical to those described with respect to FIGS. 1–4.

Figure 8:
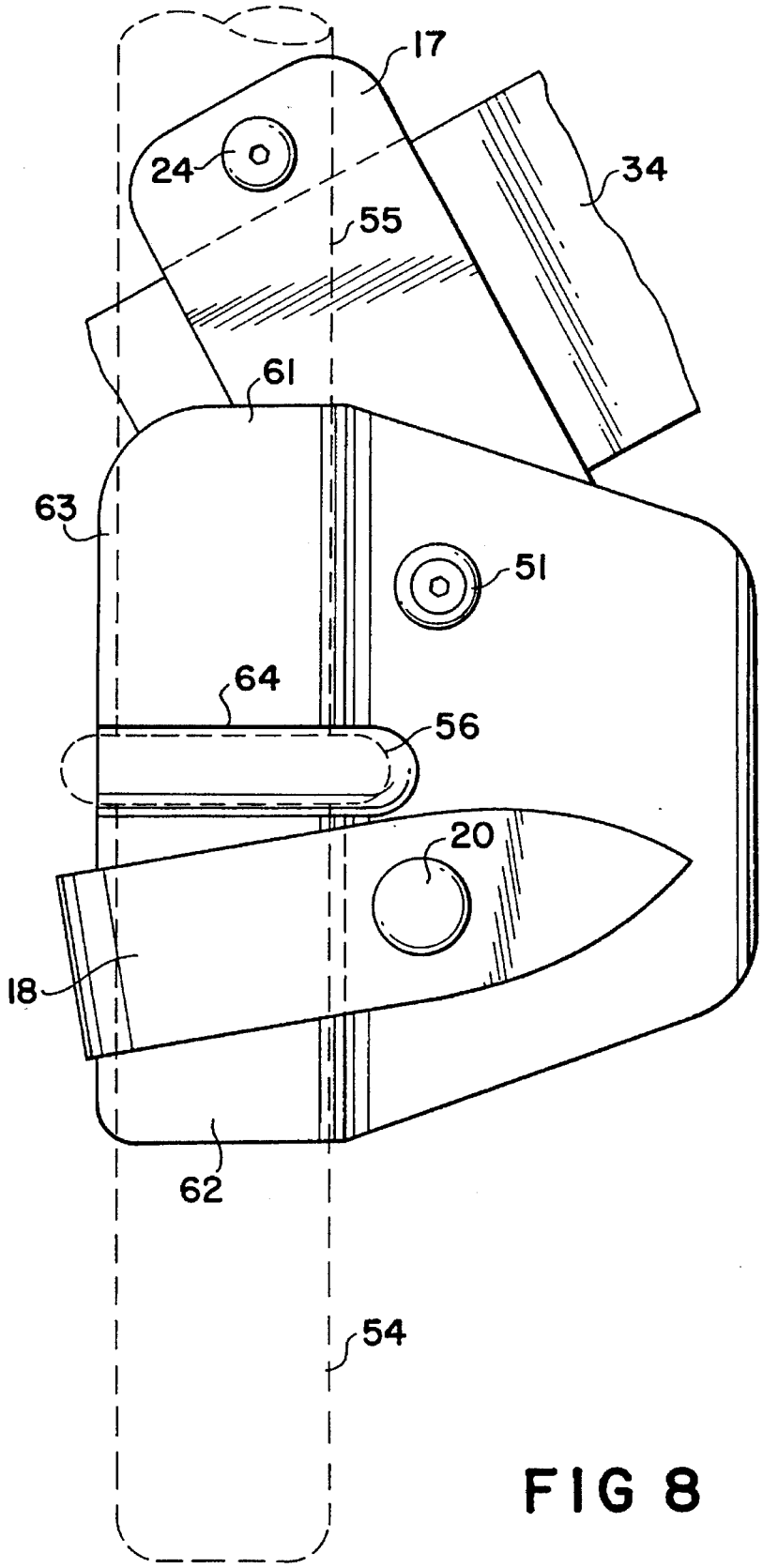
FIG. 8 is an outside elevational view of a third embodiment of the invention wherein the truncheon has no cross guard.
Figure 10:
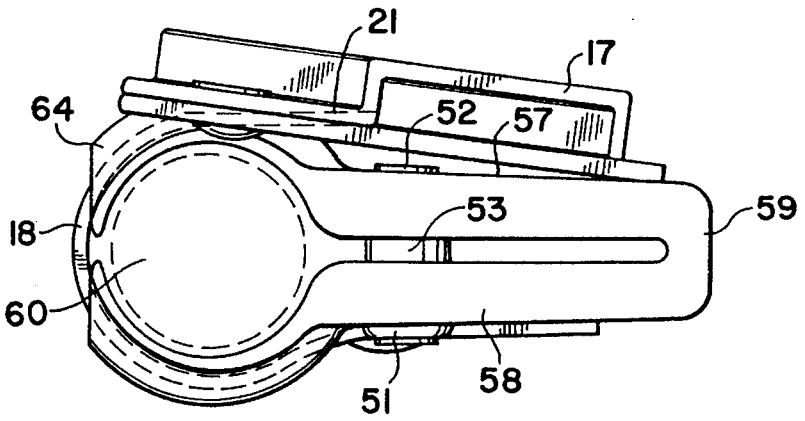
FIG. 10 is a top plan view of the embodiment of FIG. 8.
Figure 9:
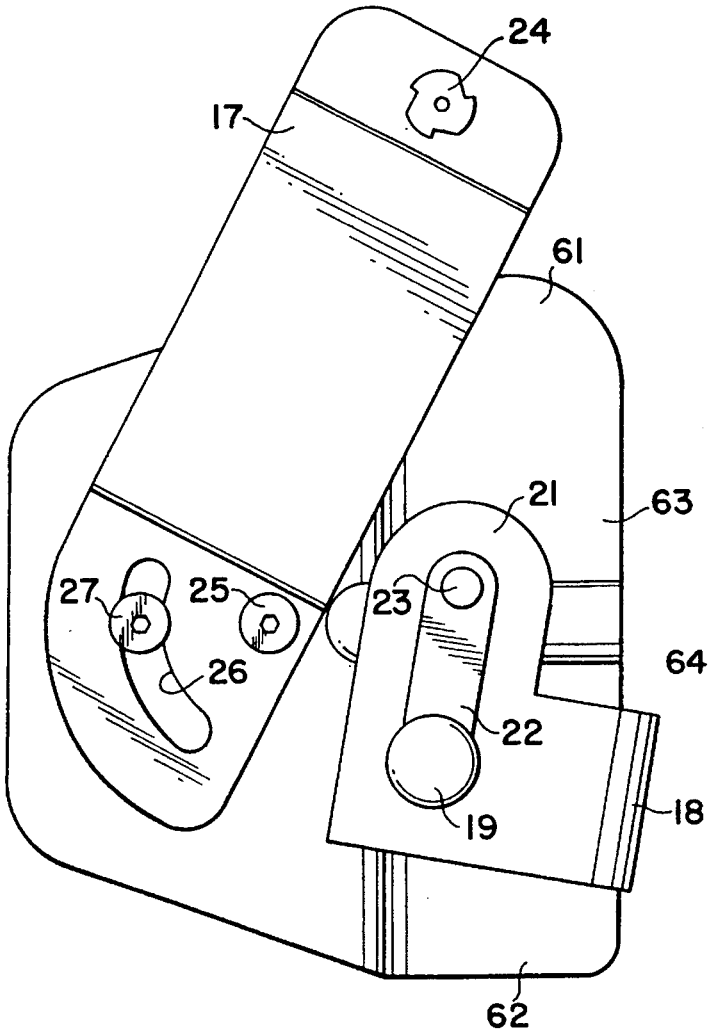
FIG. 9 is an inside elevational view of the embodiment of FIG. 8.

In FIGS. 8–10 there is shown a third embodiment of this invention, wherein the truncheon is a straight club with a handle 54 and a staff 55 aligned, but no side arm in a cross guard. This truncheon does have a raised annular ring 56 where handle 54 joins staff 55. The holster includes an inside wall 57, an outside wall 58, a folded rear 59, an internal void 60, an open top 61, an open bottom 62, and an open front 63. The holster includes an annular recess 64 which mates with ring 56 to position the truncheon in the holster. Belt loop 17, keeper strap 18, thumb tab 21, wearer's belt 34, and adjustment screw 51 are all identical to those described with respect to FIGS. 1–4.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A clam-shell holster for a truncheon having an elongated staff and a hand grip, said holster being adapted to be worn adjacent a wearer's waist to dispose said staff along a wearer's back, said holster including an inside wall, and an outside wall spring biased through a rear fold integral with said inside and outside walls, an open top adjacent the wearer's waist, an open bottom remote from the wearer's waist, an open front extending between said open top and bottom, a belt loop connected to said inside wall, and a mechanical means attached between the inside and outside walls to adjust the strength of said spring bias, said holster retaining the truncheon with the hand grip directed downwardly through said open bottom and the staff directed upwardly through said open top from the wearer's waist to adjacent the wearer's shoulder.

2. The holster of claim 1 wherein said inside wall and said outside wall are portions of a unitary folded sheet of molded plastic material, adapted to clamp around the truncheon at a position intermediate to the hand grip and the staff.

3. The holster of claim 1 which additionally includes an open rear port adjacent and below said rear fold to receive and support a portion of the cross guard on the truncheon.

4. The holster of claim 3 wherein the cross guard consists essentially of a single arm extending laterally from the staff.

5. The holster of claim 3 wherein said holster includes means for accommodating the cross guard which includes two arms extending laterally in opposite directions outward from the staff of the truncheon.

6. The holster of claim 1 wherein said holster includes a pivotal attachment screw, said belt loop having an arcuate slot positioned at a fixed radius from said attachment screw, and a clamping screw positioned in said slot and adapted to clamp said belt loop at any selected position.

7. The holster of claim 1 which additionally comprises a keeper strap connected to said outside wall and extending transversely across said open front, a quick opening snap fastener on said inside wall, a thumb-engageable tab attached to said snap fastener for releasable attaching said strap to said snap fastener.

8. The holster of claim 7 which additionally includes a springy reinforcement strip affixed to said tab and adapted to facilitate the unfastening of said snap fastener.

9. The holster of claim 7 wherein said tab extends upwardly from said snap fastener.

10. The holster of claim 1 further comprising a keeper strap having one end affixed to said outside wall and extending across said open front and a releasable fastener connecting between an opposite end of said strap and said inside wall.

11. The holster of claim 10 further comprising a tab extending laterally of said keeper strap adjacent said releasable fastener means said strap being openable by the wearer's thumb pressing inwardly on said tab.

12. A quick-opening holster to support from a wearer's belt a truncheon having an elongated staff, a hand grip at one end of said staff and a cross guard of two oppositely directed short arms extending laterally outward from the staff adjacent the hand grip; said holster comprising a unitary substantially inflexible sheet folded to a shape having an inside wall, an outside wall, an interior void, an open top, an open bottom, an open rear port and an open front, an adjustment screw attached to said outside wall and engaged with a nut attached to said inside wall to provide adjustment to a force required to pull said walls apart from each other, a keeper strap having one end affixed to said outside wall and extending across said open front, a releasable fastener connecting between an opposite end of said strap and said inside wall, and an adjustable belt loop pivotally attached to said inside wall; said holster retaining the truncheon with the hand grip directed downwardly through said open bottom and the staff directed upwardly through said open top from the wearer's waist to adjacent the wearer's shoulder.

13. The holster of claim 12 wherein said sheet is a folded plastic composition.

14. The holster of claim 13 wherein said molded sheet provides a spring bias action tending to close said walls upon each other.

15. The holster of claim 12 wherein said folded portion of said sheet is positioned to extend from said open top to said open rear port.

16. The holster of claim 12 which additionally includes a thumb-engagable semi-flexible tab extending upwardly from said keeper strap adjacent said releasable fastener on said inside wall.

17. The holster of claim 14 which additionally includes a stiffening strip on said tab extending substantially the length of said tab with one end thereof affixed to said releasable fastener on said inside wall.

18. The holster of claim 12 wherein said keeper strap is a flexible strap.

19. The holster of claim 12 wherein said belt loop is a molded plastic member pivotally attached to a pivot screw on said inside wall and having an arcuate slot positioned about said pivot screw and a clamping screw engaged in said slot and adapted to clamp said belt loop in a fixed selected position.

* * * * *